US007935008B2

(12) United States Patent
Magno

(10) Patent No.: US 7,935,008 B2
(45) Date of Patent: May 3, 2011

(54) PRACTICE BAT SYSTEM

(75) Inventor: Joseph Amerigo Magno, San Pedro, CA (US)

(73) Assignee: Joseph A. Magno, San Pedro, CA (US)

( * ) Notice: Subject to any disclaimer, the term of this patent is extended or adjusted under 35 U.S.C. 154(b) by 0 days.

(21) Appl. No.: 12/386,513

(22) Filed: Apr. 20, 2009

(65) Prior Publication Data

US 2010/0267499 A1 Oct. 21, 2010

(51) Int. Cl.
*A63B 69/00* (2006.01)

(52) U.S. Cl. ..... 473/457

(58) Field of Classification Search ..... 473/457, 473/519, 520, 530, 564–568
See application file for complete search history.

(56) References Cited

U.S. PATENT DOCUMENTS

| | | | | | |
|---|---|---|---|---|---|
| 1,944,628 | A | * | 1/1934 | Barker | 473/507 |
| 2,194,761 | A | * | 3/1940 | Maihack | 473/509 |
| 3,206,195 | A | * | 9/1965 | Myers | 473/457 |
| 3,268,226 | A | * | 8/1966 | Martino | 473/457 |
| 3,597,861 | A | * | 8/1971 | Gordon | 434/365 |
| 4,880,234 | A | * | 11/1989 | Salisbury | 473/457 |
| 5,150,896 | A | * | 9/1992 | Holmes | 473/530 |
| 5,269,511 | A | * | 12/1993 | Chavez | 473/457 |
| D352,081 | S | * | 11/1994 | Shelley | D21/729 |
| 5,653,643 | A | * | 8/1997 | Falone et al. | 473/300 |
| 5,730,662 | A | * | 3/1998 | Rens | 473/300 |
| 2008/0070725 | A1 | * | 3/2008 | Davis | 473/564 |
| 2009/0191986 | A1 | * | 7/2009 | Bohm | 473/457 |
| 2009/0325736 | A1 | * | 12/2009 | Carsello | 473/457 |
| 2009/0325737 | A1 | * | 12/2009 | Windsor | 473/457 |
| 2010/0004077 | A1 | * | 1/2010 | Shimamoto et al. | 473/564 |

FOREIGN PATENT DOCUMENTS

| | | | |
|---|---|---|---|
| GB | 2067079 | A * | 7/1981 |

* cited by examiner

*Primary Examiner* — Mark S Graham

(57) ABSTRACT

A striking section includes a planar central portion. The planar central portion has holes. A major striking surface is provided. The striking section also includes a peripheral portion. The peripheral section extends from both sides of the central portion. In this manner spaced parallel thin minor striking surfaces are provided. The peripheral portion has a distal end. The distal end is in a semi circular configuration. The distal end couples the minor striking surfaces. A handle section has a central extent. The central extent is in a generally cylindrical configuration. The central extent has a proximal end and a distal end. The distal end is coupled to the central extent of the handle section and to the proximal end of the peripheral section.

1 Claim, 3 Drawing Sheets

FIG 1
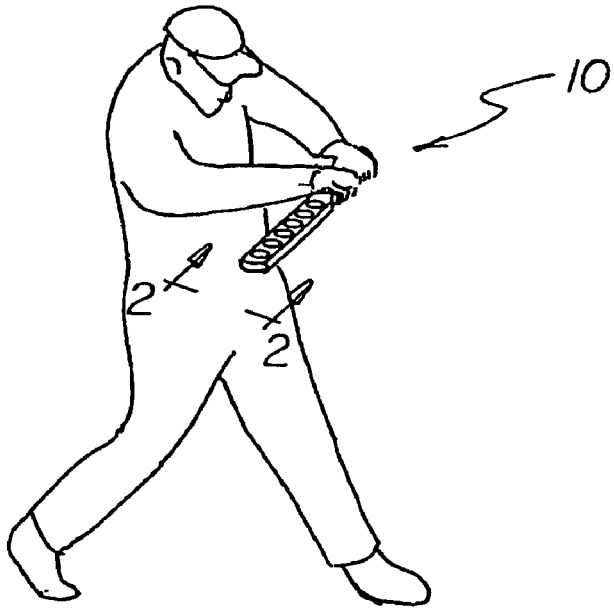
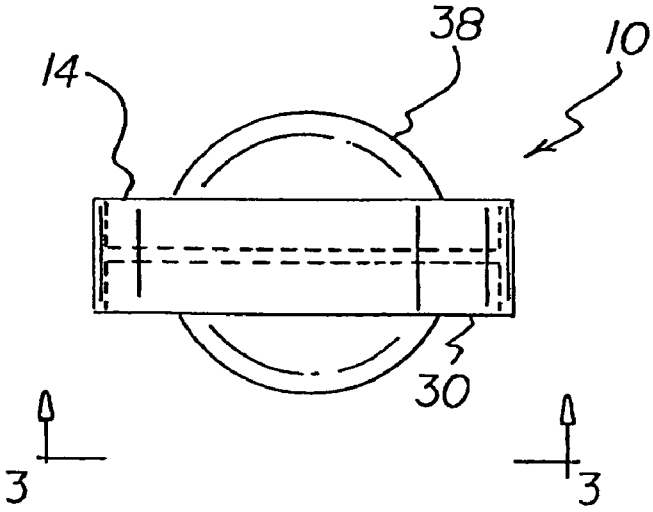
FIG 2

PRACTICE BAT SYSTEM

BACKGROUND OF THE INVENTION

1. Field of the Invention

The present invention relates to a practice bat system and more particularly pertains to improving a player's strength and hand to eye coordination in a safe, simple and convenient manner.

2. Description of the Prior Art

The use of bat systems of known designs and configurations is known in the prior art. More specifically, bat systems of known designs and configurations previously devised and utilized for the purpose of improving batting through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,338,687 issued Jan. 15, 2002 to Thompson relates to a Batting Swing Indicator. U.S. Pat. No. 5,087,039 issued Feb. 11, 1992 to Laseke relates to a Baseball Bat Swing Training Device. U.S. Pat. No. 4,583,733 issued Apr. 22, 1986 to Ito relates to a Baseball Bat Swing Measuring Device. Lastly, U.S. Pat. No. 4,577,863 issued Mar. 25, 1986 to Ito relates to a Swing Measuring Device.

While these devices fulfill their respective, particular objectives and requirements, the aforementioned patents do not describe a practice bat system that allows for improving a player's strength and hand to eye coordination in a safe, simple and convenient manner.

In this respect, the practice bat system according to the present invention substantially departs from the conventional concepts and designs of the prior art, and in doing so provides an apparatus primarily developed for the purpose of improving a player's strength and hand to eye coordination in a safe, simple and convenient manner.

Therefore, it can be appreciated that there exists a continuing need for a new and improved practice bat system which can be used for improving a player's strength and hand to eye coordination in a safe, simple and convenient manner. In this regard, the present invention substantially fulfills this need.

SUMMARY OF THE INVENTION

In view of the foregoing disadvantages inherent in the known types of bat systems of known designs and configurations now present in the prior art, the present invention provides an improved practice bat system. As such, the general purpose of the present invention, which will be described subsequently in greater detail, is to provide a new and improved practice bat system and method which has all the advantages of the prior art and none of the disadvantages.

To attain this, the present invention essentially comprises a practice bat system. First provided is a striking section. The striking section includes a planar central portion. The planar central portion is in a generally rectilinear configuration. The planar central portion has a length of about 18.5 inches. The planar central portion has a width of about 2.25 inches. The planar central portion has a thickness of about 0.0625 inches. The planar central portion is adapted to provide a major striking surface. The major striking surface is provided on each side of the central portion. The planar central section has 7 holes. Equal spacing is provided between the holes. The holes have a diameter of about 2.25 inches. In this manner wind resistance while practice swinging is minimized to improve a player's wrist strength and movement. The striking section also includes a peripheral portion. The peripheral portion extends an equal distance from both sides of the central portion. In this manner spaced parallel thin minor striking surfaces are provided. The minor striking surface has a length of about 18 inches. The minor striking surface has a width of about 0.75 inches. The minor striking surface has a thickness of about 0.0625 inches. The minor striking surfaces, when used with a wiffle ball, are adapted improve a player's hand to eye coordination. The peripheral portion has a distal end. The distal end is in a semi circular configuration. The distal end couples the minor striking surfaces. The major striking surface has a width between about 2.5 and 3.5 times the width of the minor striking surface. The minor striking surface is greater than the thickness of the major striking surface.

Further provided is a handle section. The handle section has a central extent. The central extent is in a generally cylindrical configuration. The central extent has a diameter of about 0.625 inches. The central extent has a length of about 11.5 inches. The handle section has a proximal end. The proximal end is in a disk shaped configuration. The proximal end has a diameter of about 2 inches. The proximal end is separably coupled to the central extent. The handle section has a distal end. The distal end is in a trapezoid configuration. The smaller end of the trapezoid is coupled to the central extent of the handle section. The larger end of the trapezoid is coupled to the proximal end of the peripheral section. The striking section and the handle section are fabricated of aluminum.

Provided last is a grip. The grip is fabricated of an elastomeric material selected. The elastomeric material is selected from the class of elastomeric materials. The class of elastomeric materials includes plastic and rubber, natural and synthetic, and blends thereof. The grip has an interior cylindrical surface for mounting on the handle. The grip has an exterior surface for gripping by a user. The exterior surface has a semi-cylindrical region. The exterior surface has flat parallel side faces. The exterior surface has a flat front face. The flat front face is provided parallel with one of the minor striking surfaces.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved practice bat system which has all of the advantages of the prior art bat systems of known designs and configurations and none of the disadvantages.

It is another object of the present invention to provide a new and improved practice bat system which may be easily and efficiently manufactured and marketed.

It is further object of the present invention to provide a new and improved practice bat system which is of durable and reliable constructions.

An even further object of the present invention is to provide a new and improved practice bat system which is susceptible of a low cost of manufacture with regard to both materials and labor, and which accordingly is then susceptible of low prices of sale to the consuming public, thereby making such practice bat system economically available to the buying public.

Even still another object of the present invention is to provide a practice bat system for improving a player's strength and hand to eye coordination in a safe, simple and convenient manner.

Lastly, it is an object of the present invention to provide a new and improved practice bat system. A striking section includes a planar central portion. The planar central portion has holes. A major striking surface is provided. The striking section also includes a peripheral portion. The peripheral section extends from both sides of the central portion. In this manner spaced parallel thin minor striking surfaces are provided. The peripheral portion has a distal end. The distal end is in a semi circular configuration. The distal end couples the minor striking surfaces. A handle section has a central extent. The central extent is in a generally cylindrical configuration. The central extent has a proximal end and a distal end. The distal end is coupled to the central extent of the handle section and to the proximal end of the peripheral section.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a practice bat system constructed in accordance with the principles of the present invention.

FIG. 2 is a front elevational view of the system taken along line 2-2 of FIG. 1.

The same reference numerals refer to the same parts throughout the various Figures.

DESCRIPTION OF THE PREFERRED EMBODIMENT

Figure 3:
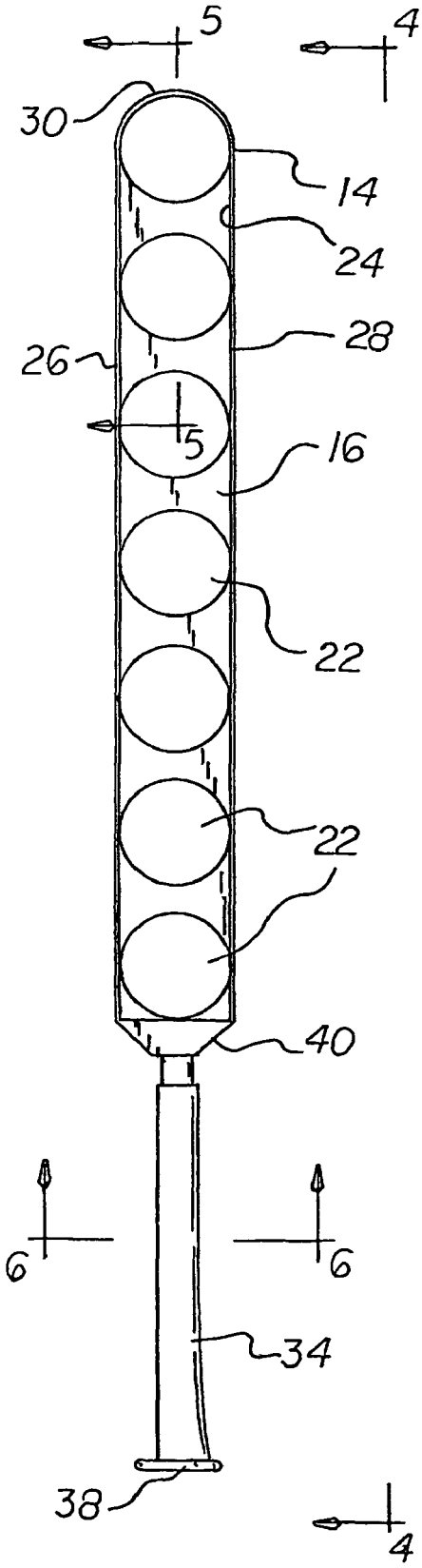
FIG. 3 is a plan view of the system taken along line 3-3 of FIG. 2.
Figure 4:
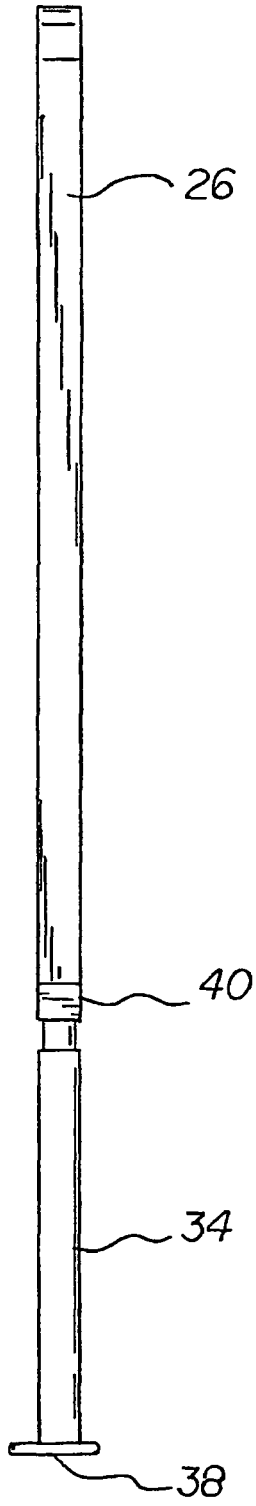
FIG. 4 is a side elevational view of the system taken along line 4-4 of FIG. 3.
Figure 5:
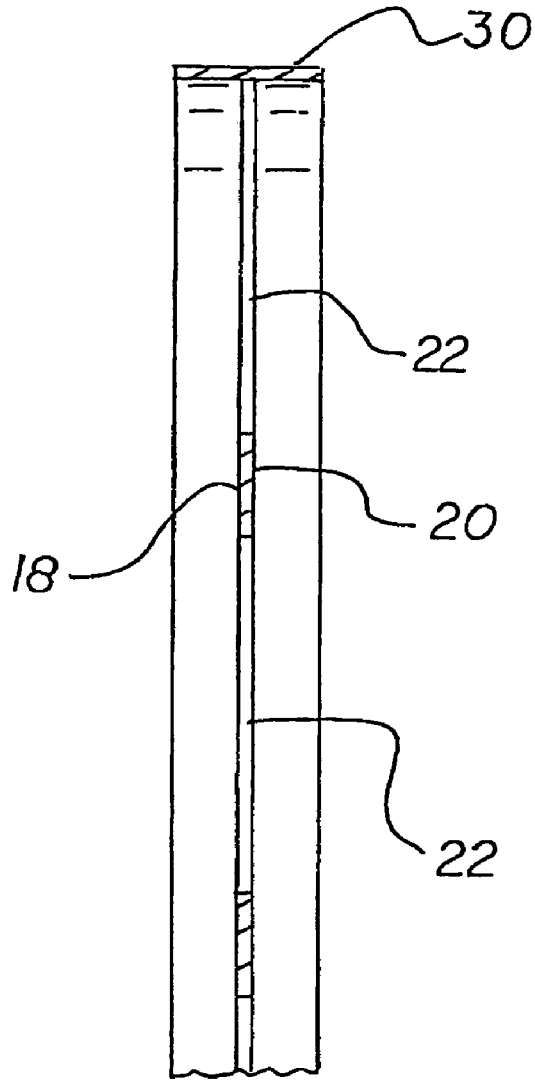
FIG. 5 is a cross sectional view of the system taken along line 5-5 of FIG. 3.
Figure 6:
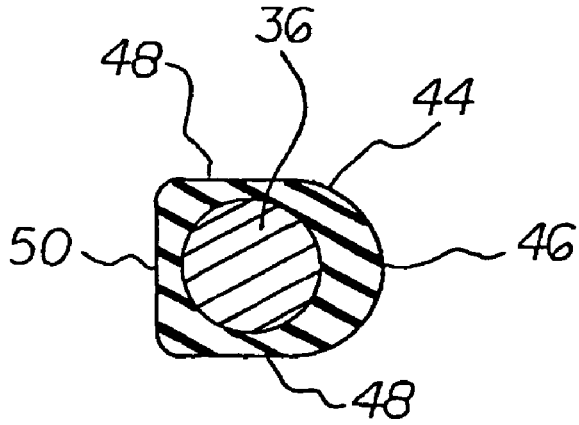
FIG. 6 is a cross sectional view of the system taken along line 6-6 of FIG. 3.

With reference now to the drawings, and in particular to FIG. 1 thereof, the preferred embodiment of the new and improved practice bat system embodying the principles and concepts of the present invention and generally designated by the reference numeral 10 will be described.

The present invention, the practice bat system 10 is comprised of a plurality of components. Such components in their broadest context include a striking section and a handle section. Such components are individually configured and correlated with respect to each other so as to attain the desired objective.

First provided is a striking section 14. The striking section includes a planar central portion 16. The planar central portion is in a generally rectilinear configuration. The planar central portion has a length of about 18.5 inches. The planar central portion has a width of about 2.25 inches. The planar central portion has a thickness of about 0.0625 inches. The planar central portion is adapted to provide a major striking surface 18, 20. The major striking surface is provided on each side of the central portion. The planar central section has 7 holes 22. Equal spacing is provided between the holes. The holes have a diameter of about 2.25 inches. In this manner wind resistance while practice swinging is minimized to improve a player's wrist strength and movement. The striking section also includes a peripheral portion 24. The peripheral portion extends an equal distance from both sides of the central portion. In this manner spaced parallel thin minor striking surfaces 26, 28 are provided. The minor striking surface has a length of about 18 inches. The minor striking surface has a width of about 0.75 inches. The minor striking surface has a thickness of about 0.0625 inches. The minor striking surfaces, when used with a wiffle ball, are adapted improve a player's hand to eye coordination. The peripheral portion has a distal end 30. The distal end is in a semi circular configuration. The distal end couples the minor striking surfaces. The major striking surface has a width between about 2.5 and 3.5 times the width of the minor striking surface. The minor striking surface is greater than the thickness of the major striking surface.

Further provided is a handle section 34. The handle section has a central extent 36. The central extent is in a generally cylindrical configuration. The central extent has a diameter of about 0.625 inches. The central extent has a length of about 11.5 inches. The handle section has a proximal end 38. The proximal end is in a disk shaped configuration. The proximal end has a diameter of about 2 inches. The proximal end is separably coupled to the central extent. The handle section has a distal end 40. The distal end is in a trapezoid configuration. The smaller end of the trapezoid is coupled to the central extent of the handle section. The larger end of the trapezoid is coupled to the proximal end of the peripheral section. The striking section and the handle section are fabricated of aluminum.

Provided last is a grip 44. The grip is fabricated of an elastomeric material selected. The elastomeric material is selected from the class of elastomeric materials. The class of elastomeric materials includes plastic and rubber, natural and synthetic, and blends thereof. The grip has an interior cylindrical surface 46 for mounting on the handle. The grip has an exterior surface for gripping by a user. The exterior surface has a semi-cylindrical region. The exterior surface has flat parallel side faces 48. The exterior surface has a flat front face 50. The flat front face is provided parallel with one of the minor striking surfaces.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A practice bat system for improving a player's strength and hand to eye coordination in a safe, simple and convenient manner comprising, in combination:

a striking section including a planar central portion in a generally rectilinear configuration with a length of about 18.5 inches and a width of about 2.25 inches and a thickness of about 0.0625 inches adapted to provide a major striking surface on each side of the central portion, the planar central section having 7 holes of equal spacing and a diameter of about 2.25 inches there through for minimizing wind resistance while practice swinging to improve a player's wrist strength and movement, the striking section also including a peripheral portion extending an equal distance from both sides of the central portion to provide spaced parallel thin minor striking surfaces with a length of about 18 inches and a width of about 0.75 inches and a thickness of about 0.0625 inches, the minor striking surfaces, when used with a wiffle ball, being adapted improve a player's hand to eye coordination, the peripheral portion having a distal end in a semi circular configuration coupling the minor striking surfaces, the major striking surface having a width between about 2.5 and 3.5 times the width of the minor striking surface, the minor striking surface being greater than the thickness of the major striking surface;

a handle section having a central extent in a generally cylindrical configuration with a diameter of about 0.625 inches and a length of about 11.5 inches, the handle section having a proximal end in a disk shaped configuration with a diameter of about 2 inches and being separably coupled to the central extent, the handle section having a distal end in a trapezoid configuration with a smaller end of the trapezoid coupled to the central extent of the handle section and the larger end of the trapezoid coupled to the proximal end of the peripheral section, the striking section and the handle section being fabricated of aluminum; and a grip fabricated of an elastomeric material selected from the class of elastomeric materials including plastic and rubber, natural and synthetic, and blends thereof, the grip having an interior cylindrical surface for mounting on the handle and an exterior surface for gripping by a user, the exterior surface having a semi-cylindrical region and flat parallel side faces with a flat front face parallel with one of the minor striking surfaces.

* * * * *